US010920382B2

(12) United States Patent
Claussen

(10) Patent No.: US 10,920,382 B2
(45) Date of Patent: Feb. 16, 2021

(54) BRIDGE DECKING AND INSTALLATION

(71) Applicant: Cory W. Claussen, Missoula, MT (US)

(72) Inventor: Cory W. Claussen, Missoula, MT (US)

(73) Assignee: TRUENORTH STEEL, INC., West Fargo, ND (US)

( * ) Notice: Subject to any disclaimer, the term of this patent is extended or adjusted under 35 U.S.C. 154(b) by 0 days.

(21) Appl. No.: 16/526,603

(22) Filed: Jul. 30, 2019

(65) Prior Publication Data

US 2020/0032465 A1 Jan. 30, 2020

Related U.S. Application Data

(60) Provisional application No. 62/711,897, filed on Jul. 30, 2018.

(51) Int. Cl.

| | |
|---|---|
| ***E01D 21/00*** | (2006.01) |
| ***E01D 19/12*** | (2006.01) |
| ***E01C 5/16*** | (2006.01) |

(52) U.S. Cl.
CPC ..... *E01D 19/125* (2013.01); *E01C 5/16* (2013.01); *E01D 21/00* (2013.01)

(58) Field of Classification Search
CPC ..... E01C 5/16; E01D 19/125; E01D 21/00
USPC ..... 14/73–78; 52/83, 745.06, 223.6
See application file for complete search history.

(56) References Cited

U.S. PATENT DOCUMENTS 4,706,319 A * 11/1987 Sivachenko ..... E01D 2/04 14/73
5,471,694 A * 12/1995 Meheen ..... E01D 2/04 14/73
5,730,248 A * 3/1998 Apostolopoulos .... E01D 19/106 182/138
6,006,483 A * 12/1999 Lee ..... E04B 5/40 52/414
6,170,105 B1 * 1/2001 Doyle ..... E01D 19/125 14/6
6,415,581 B1 * 7/2002 Shipman ..... E04B 5/40 428/593
6,578,343 B1 * 6/2003 Dumler ..... E01D 19/125 14/73
6,817,444 B1 * 11/2004 Shinas ..... E01D 19/106 14/74
6,904,636 B2 * 6/2005 Hwang ..... E01D 19/125 14/73
7,143,555 B2 * 12/2006 Miller ..... E04B 5/046 52/252
7,571,576 B2 * 8/2009 Pruitt ..... E04B 1/003 52/250
8,316,495 B2 * 11/2012 He ..... E01D 2/02 14/73

(Continued)

FOREIGN PATENT DOCUMENTS

GB 786847 * 4/1956 ..... E04B 5/01

*Primary Examiner* — Raymond W Addie

(74) *Attorney, Agent, or Firm* — Westman, Champlin & Koehler, P.A.

(57) ABSTRACT

A pre-fabricated deck panel includes a plurality of corrugations extending transversely along a length, and a pre-fabricated end dam on at least one end of the panel. The end dam extends to a height of the corrugations. The panel may further include at least one pre-fabricated side edge dam on at least one side of the panel. The side edge dam extends to height above the corrugations.

14 Claims, 7 Drawing Sheets

(56) References Cited

U.S. PATENT DOCUMENTS

| | | | | |
|---|---|---|---|---|
| 8,424,263 | B2 * | 4/2013 | Hsieh | E04B 5/04 52/414 |
| 8,572,788 | B2 * | 11/2013 | Kurek | E04G 13/04 14/73 |
| 2004/0055249 | A1 * | 3/2004 | Kennedy | B29C 70/745 52/794.1 |
| 2005/0283926 | A1 * | 12/2005 | Pollard | E01D 21/00 14/77.1 |
| 2006/0117504 | A1 * | 6/2006 | Ronald | E01D 19/125 14/73 |
| 2006/0272111 | A1 * | 12/2006 | Kim | E01D 19/125 14/73 |
| 2007/0000077 | A1 * | 1/2007 | Wilson | E01D 19/125 14/73 |
| 2008/0078038 | A1 * | 4/2008 | Borazghi | B32B 3/26 14/73 |
| 2009/0077758 | A1 * | 3/2009 | Vincent | E01D 19/125 14/73 |
| 2010/0043153 | A1 * | 2/2010 | Lerner | E01D 6/00 14/6 |

* cited by examiner

BRIDGE DECKING AND INSTALLATION

BACKGROUND

Low volume roads may be paved with asphalt, concrete, gravel, or other crushed aggregate. Many roads, especially those paved with gravel or other crushed aggregate, may have sound underlying structure on bridges, but have deteriorating and/or damaged decking, due to weather, grading, plowing, aging, and the like. Significant portions of bridge decking and driving surface may need replacement on bridges for such roads.

Traditional bridge decking comes in multiple pieces including corrugated panels which are typically one corrugation, or maybe two corrugations, and which are aligned and connected to one another to form a bed for decking, such as gravel, ballast, asphalt, or concrete. Setting individual sheets of one or two corrugations for a 24'×50' traditional structure bridge would use 50×1 foot pieces each 24 feet wide, requiring 50 pieces to be welded down and connected to each other. Often, even a small bridge can require at least 50-100 or more corrugated pieces.

Further, at the side edges of the bridge parallel to the roadway over which the bridge extends, and at the ends of entrance/exit to/from the bridge, edge dams (e.g., side dams, end dams) must also be attached to prevent the decking material (e.g., gravel, ballast) from spilling off the side or end of the bridge. As bridges are often elevated, and as the side dams especially are at edges that may be difficult or dangerous to reach, installation of side dams using traditional methods of bridge decking layout is problematic and time consuming.

SUMMARY

A pre-fabricated deck panel in one embodiment includes a plurality of corrugations extending transversely along a length, and a pre-fabricated end dam on at least one end of the panel. The pre-fabricated end dam extends to a height of the corrugations.

In another embodiment, a pre-fabricated decking panel for a roadway includes a plurality of continuous corrugations extending laterally from a first side edge of the panel to a second opposite side edge of the panel, and continuous for a length of the panel from a first end to a second opposite end. A pre-fabricated side edge dam is provided on at least one side of the panel. The side edge dam extends to height above the corrugations.

In another embodiment, a method of installing a bridge decking surface includes placing at least one pre-fabricated decking panel a plurality of corrugations extending transversely along a length thereof on an existing bridge support structure, and connecting the at least one pre-fabricated decking panel to the existing bridge support structure using pre-formed holes therein.

DESCRIPTION OF EMBODIMENTS

Figure 1:
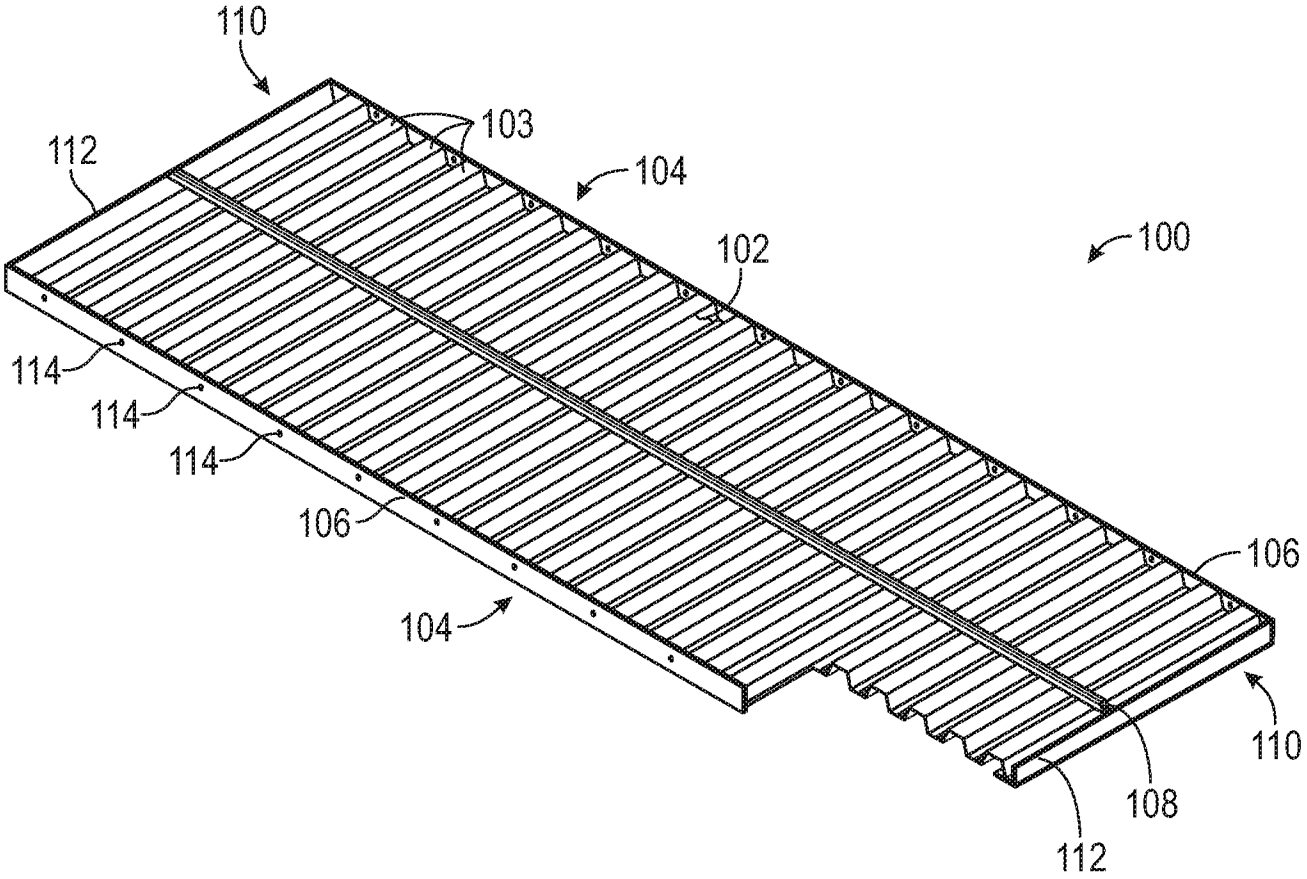
FIG. 1 is a perspective view of a decking panel according to an embodiment of the present disclosure.

Embodiments of the present disclosure provide pre-fabricated large sections of decking base for roadbeds such as bridges and the like. The embodiments include much larger sections of decking base than have been traditionally used. The embodiments of the present disclosure are particularly useful for modular pre-fabricated bridge deck panels, for example 8×24 feet (Width×Length) panels. While 8'×24' is discussed, it should be understood that longer panels may be utilized without departing from the scope of the disclosure. For example, a 24'×50' traditional structure bridge could use three 8'×50' panels.

In some embodiments, the pre-fabricated deck panels are provided with prefabricated end and side dams that are attached during manufacture to the ends and/or sides of the large decking base panels. In contrast, when individual pieces are used, such as 50 or more 1'×24' sections, no pre-fabricated side dams may be used, and attachment of side dams to the traditional individual piece bridge decking replacements adds additional time and effort to replacement. Further, as has been mentioned, installation of side dams after placing individual pieces for a new bridge deck, may be very dangerous and difficult.

In further embodiments, the panel sections may be pre-drilled or pre-punched with holes for attachment to an underlying bridge structure and to each other. Pre-punching allows a field welded connection to existing steel girders. For a 24'×50' bridge deck, instead of the 50 1'×24' pieces, which are traditionally welded down and attached to one another, three 8'×50' panels are used in embodiments of the present disclosure. This economy of scale means fewer attachment points for a bridge, in that only three panels are attached to one another and to the underlying bridge support, versus 50 pieces. Further, the larger pre-fabricated size of the panels allows for a more efficient connection to the underlying decking, and in some embodiments does not use welding, but instead may be efficiently connected to the underlying bridge structure such as by bolting or other fastening methods. This also serves, with the large panelized structure of the present embodiments, to provide additional structural stability to the underlying bridge support. With panels of a large size, precise placement of holes for attachment to underlying bridge structures may be factory provided, if bridge underlying structure dimensions are provided by the organization maintaining the roadway, or measured in advance.

Still further, the pre-fabricated decking sections may be provided with blade runners, which stiffen and strengthen the panels to reduce flexing or twisting when picking and installing with a crane or excavator. Blade runners in one embodiment comprise tube steel. Blade runners may also be used as pick points for ease of installation. Blade runners are also important once gravel road mix is placed and compacted on the decking panels. If a blade operator happens to take too much material off the deck, the grader blade will scrape along the tube steel blade runners and not damage the installed galvanized corrugated deck panel.

Embodiments of the present disclosure provide the ability to replace large sections of decking on bridges for which the underlying bridge supports are sound, and at significant time savings, or for new decking solutions. The larger sections downer capable of being installed much more quickly than individual pieces, are provided in some embodiments with pre-fabricated side and end dams, and are in some embodiments pre-drilled for attachment to the underlying bridge material and to each other in a more efficient manner, such as with fewer fasteners. Installation of a single pre-fabricated panel in place of 12-24 individual one- or two-corrugation panels provides a significant time saving over the individual panel placements, since end dams and side dams may be provided from the factory, and the large panels save installation time over individual pieces.

The types of bridges that can be rehabilitated using embodiments of the present disclosure are not limited to steel bridges. Embodiments of the present disclosure may be used, for example, on existing concrete or timber bridges, or the like, without departing from the scope of the disclosure.

While one use of the pre-fabricated panels of the present disclosure is low volume gravel county roads, embodiments may be used with asphalt or concrete roads and pavement material for bridges as well. Panelizing bridge decking to a unit so no small individual pieces are used provides a large time savings in installation. This is important, especially for low volume county roads, which often are one lane, so that closure of the bridge is a large inconvenience to travel. The embodiments of the present disclosure reduce closure times due to shutdowns, etc.

A road or bridge decking panel 100 according to an embodiment of the present disclosure is shown in perspective view in FIG. 1. Panel 100 is in one embodiment provided with a corrugated galvanized metal base 102, with corrugations 103 extending between sides 104. The extension direction of the corrugations of the base 102 is in one embodiment substantially perpendicular to a direction of travel over which vehicles or other traffic will cross the decking panel. At sides 104, prefabricated side dams 106 are positioned.

At a center of the panel 100 between sides 104 a blade runner 108 is positioned, extending longitudinally between ends 110 of the panel 100. Blade runner 108 in one embodiment is steel tubing, such as 2"×2" steel tubing. Blade runners such as runner 108 provide protection to the actual decking from maintenance/plowing operations on the roadway, such as by a road grader or plow. Grader or plow blades can sometimes dig too deeply into the roadway, especially when the roadways is gravel or the like. The blade runners 108 act as a protection against that by having the blade run against the tubing of the blade runner 108 instead of potentially digging into the roadway material enough to contact and potentially damage the underlying decking panel. In one embodiment, at an end 110 of a panel 100, blade runners 108 have a beveled end 109 so that any blade that hits the blade runner will be able to ride up and onto the runner 108 more easily.

Side dams 106 extend upward from a lowest point of the corrugations of base 102 to above a top of the corrugations 103, and above any tube steel or angle blade runners 108 present on the panel. The side dam(s) 106 extend upward to match an expected depth of a driving surface material, aggregate, asphalt, or concrete. End dams 112 are, in one embodiment, prefabricated at ends 110 of the panel 100. Side dams 106 and end dams 110 are designed to contain aggregate or other pavement/roadway material that is deposited or otherwise placed on the panel 100 to form a roadway for a bridge or the like for which the panel 100 is being used.

It is contemplated that multiple panels 100 may be joined together to form a roadway or bridge deck. Accordingly, bolt holes 114 are provided in one embodiment in the side dams 106 at intervals, in one embodiment every two corrugations 103, for connecting or splicing two panels 100 together. Panels 100 may be joined using splice bolts (see FIG. 11C) through mating holes on adjacent panels 100. It should be understood that additional ways of connecting two panels may be used without departing from the scope of the disclosure, including more permanent joining methods such as welding or the like. Further, to facilitate lifting and movement of panels 100 during installation, lifting points such as pad eyes may be positioned on panel 100.

Traditional corrugated decking is assembled in smaller pieces, such as 1'×24' pieces. A 24'wide×50'long bridge, for example, uses on the order of 50 one foot pieces of corrugated metal, each of which must be attached to the previous piece and to the underlying bridge support. Installation time alone for making dozens of joins exceeds the time for joining only three panels such as panels 100A, 100B, and 100C, each 8'×50'.

Figure 2:
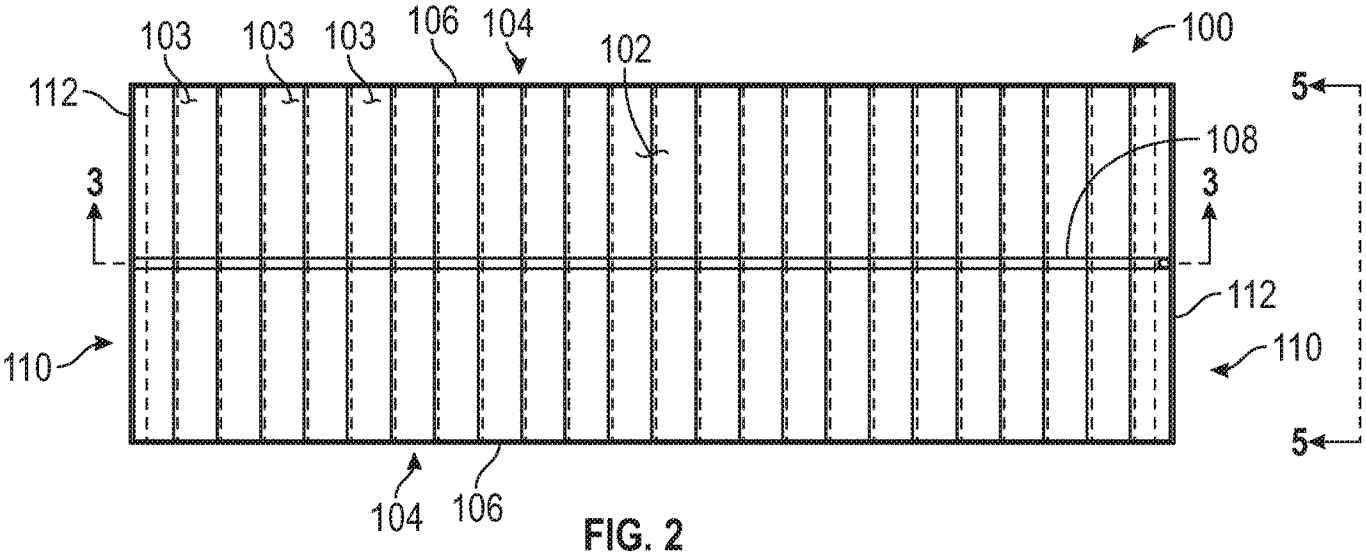
FIG. 2 is a top view of the decking panel of FIG. 1.
Figure 3:
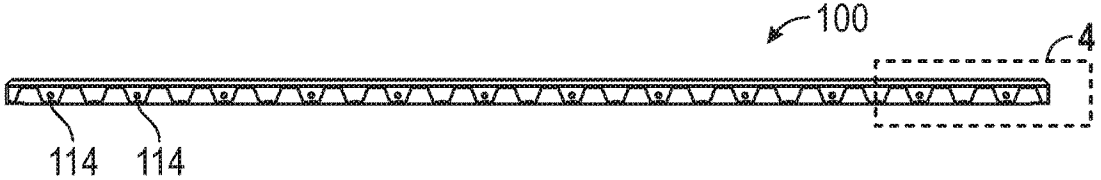
FIG. 3 is a section view of the panel of FIG. 2 taken along lines 3-3 thereof.
Figure 5:
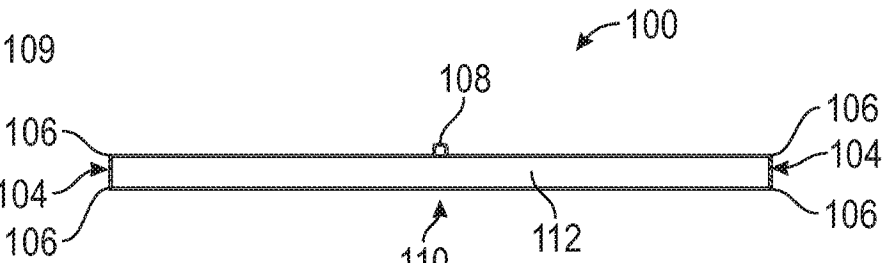
FIG. 5 is a section view of the panel of FIG. 2 taken along lines 5-5 thereof.
Figure 4:
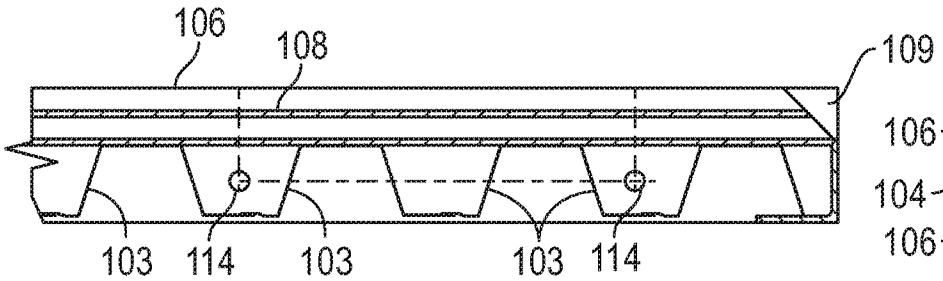
FIG. 4 is an enlarged view of a portion of the section view of FIG. 3.

A panel 100 is shown in top view in FIG. 2, and an elevation taken along lines 3-3 of FIG. 2 is shown in FIG. 3. FIG. 4 is an enlarged view of section 310 of FIG. 4. FIG. 5 is an elevation view taken along lines 5-5 of FIG. 2.

Figure 6:
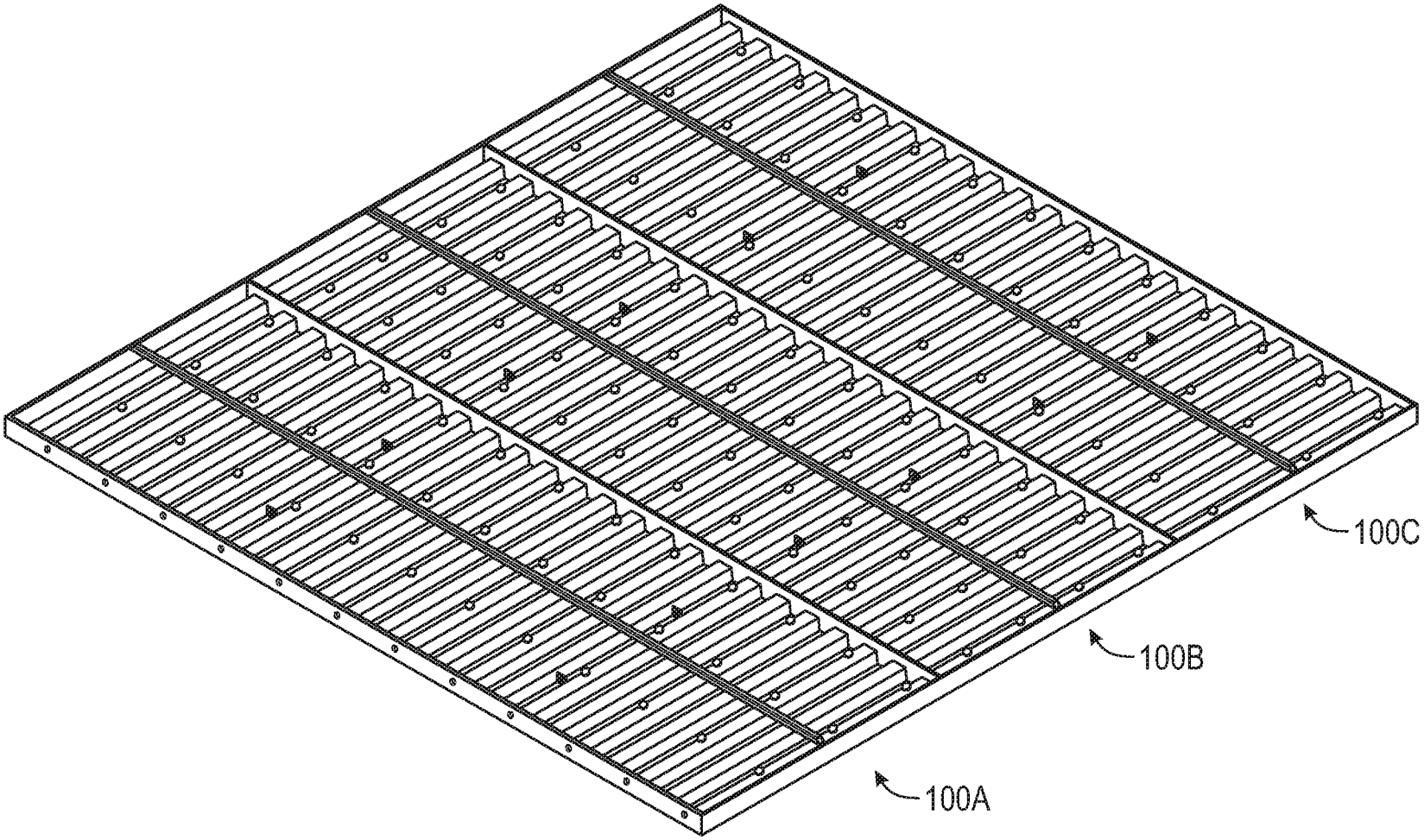
FIG. 6 is a perspective view of a plurality of panels arranged in a mating configuration according to an embodiment of the present disclosure.
Figure 7:
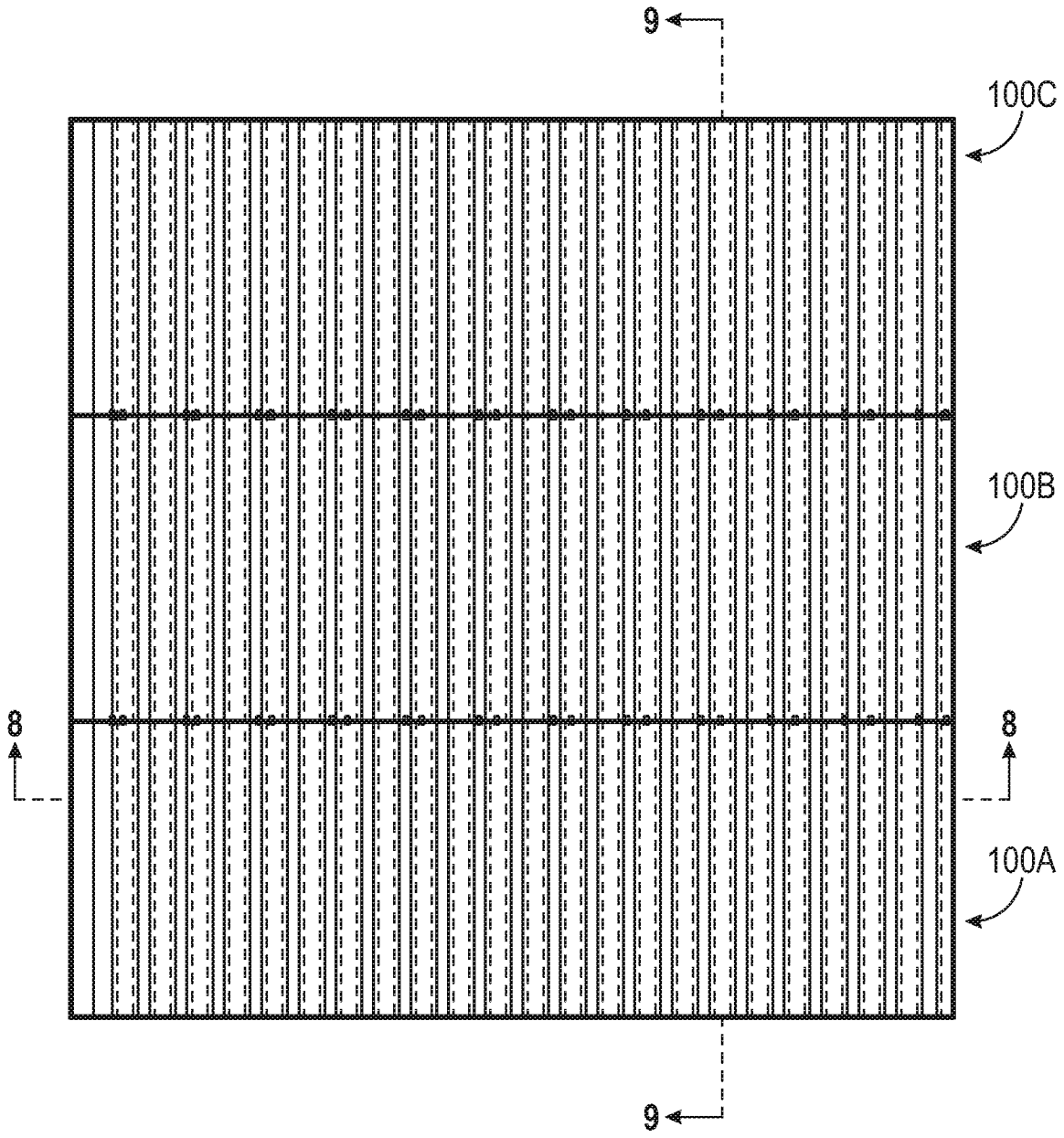
FIG. 7 is a top view of the decking panel configuration of FIG. 6.
Figure 8:
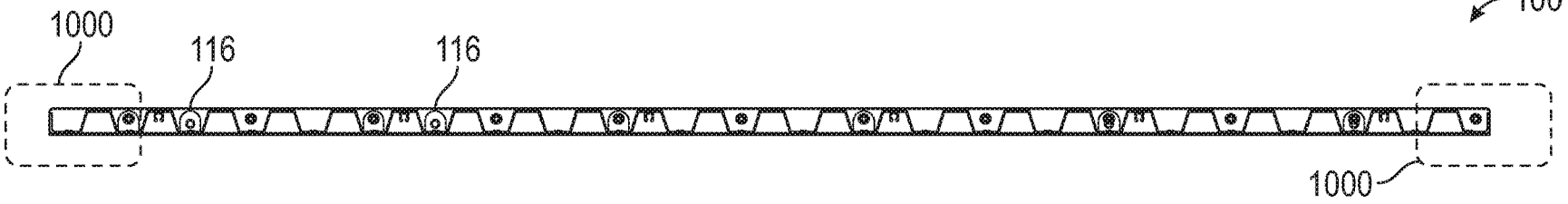
FIG. 8 is a section view of the configuration of FIG. 7 taken along lines 8-8 thereof.

FIG. 6 is a perspective view of three panels 100A, 100B, and 100C of pre-fabricated decking placed side by side to form a bridge deck. FIG. 7 is a top view of the three panels of FIG. 6. When the decking surface comprises multiple panels 100 in width, side dams 106 may be provided only on exterior portions of the panels 100, so that the splice joins between adjacent panels do not have side dams that would potentially stick above the roadway material. FIG. 8 is a section view taken along lines 8-8 of FIG. 7.

Side dams in one embodiment are provided installed from the factory, and do not need to be attached after installation. Instead, for single-panel width roads, a panel 100 with side dams 106 on both lateral sides 104 may be provided. For multiple-panel width roads, as discussed above, panels with one (or zero if the number of panels is greater than two) side dam 106 may be provided without departing from the scope of the disclosure.

Figure 9:
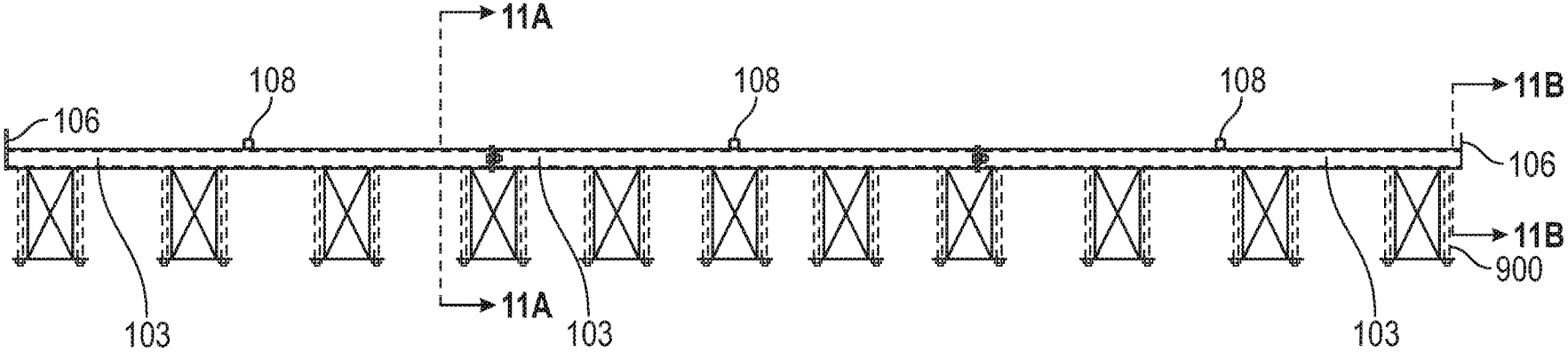
FIG. 9 is a section view of the configuration of FIG. 7 taken along lines 9-9 thereof.

FIG. 9 is a section view taken along lines 9-9 of FIG. 7, and shows placement of the panels 100A, 100B, and 100C on an existing bridge having wood stringers 900. Transverse spacing across the width of the panels may be provided prior to fabrication of the panels 100 so that attachment holes may be predrilled into the panels 100 using proper spacing for the underlying bridge structure.

Figure 10:
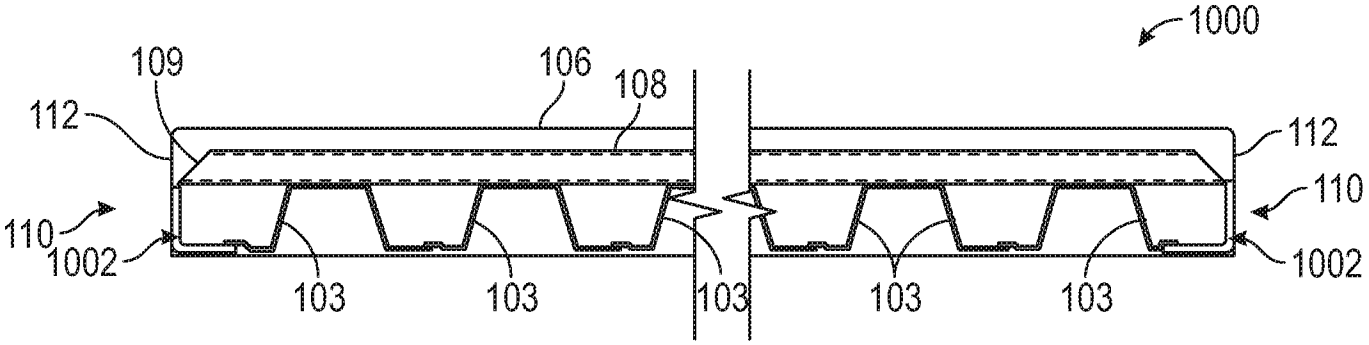
FIG. 10 is a side section view of end portions of a panel as shown in FIG. 8.

FIG. 10 is an expanded partial sectional view of the end areas 1000 shown in FIG. 8. Corrugations extend between ends 110, with end dams 112 at each end of the panel. Blade runner 108 formed as a steel tube is shown, with side dam 112 extending vertically above a top of the corrugations 103 and blade runner 108. In one embodiment, a length of the panel 100 may not line up directly with an end of a corrugation. In such a situation, an L-shaped end guard 1002 may be used at an end or ends 110 of the panel 100.

Figure 11C:
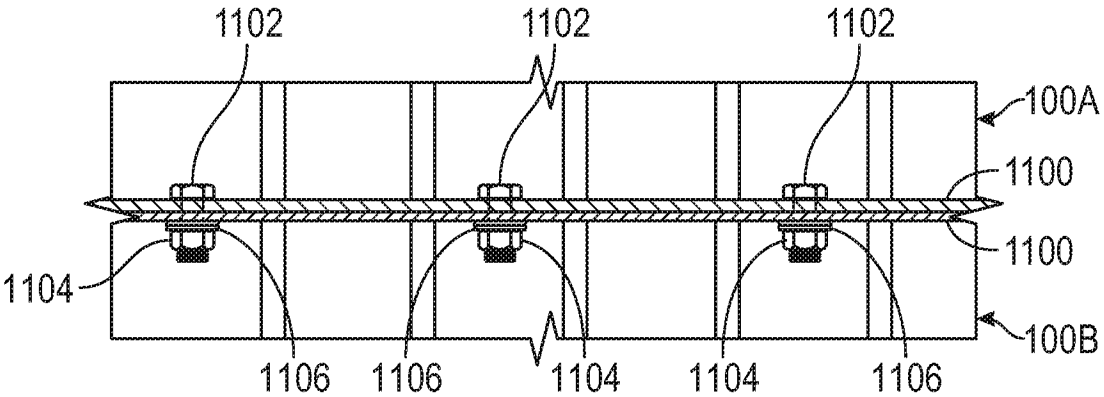
FIG. 11C is a top view of a splice joint according to an embodiment of the present disclosure.
Figure 11A:
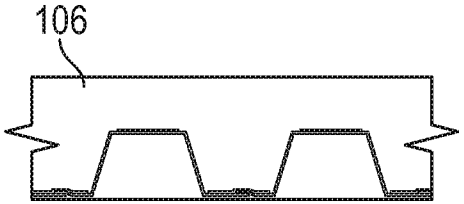
FIG. 11A is a partial elevation view of a section of corrugations and a side dam according to an embodiment of the present disclosure.
Figure 11B:
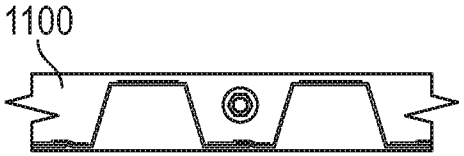
FIG. 11B is a partial elevation view of a section of corrugations and a splice joint according to an embodiment of the present disclosure.

FIG. 11A shows a section of corrugations with a side dam 106. For comparison, FIG. 11B shows a section of corrugations with a splice edge 1100. Splice edge, as discussed above, in one embodiment, does not extend vertically as far up as side dam 106. FIG. 11B also shows a splice bolt hole 114 for acceptance of a splice bolt (FIG. 11C) to connect adjacent panels 100.

FIG. 11C is a top view of a section of a first panel 100A and second panel 100B spliced together along splice edges 110 using splice bolts 1102 and nuts 1104. Splice bolts 1102 and nuts 1104 may also be used with washers 1106, as will be understood by those of skill in the art. Additional or different splicing structures including but not limited to welding may also be used without departing from the scope of the disclosure. While panels are shown aligning side to side with matching end placements, it should be understood that staggering panels so that their ends do not align is within the scope of the disclosure.

Figure 13:
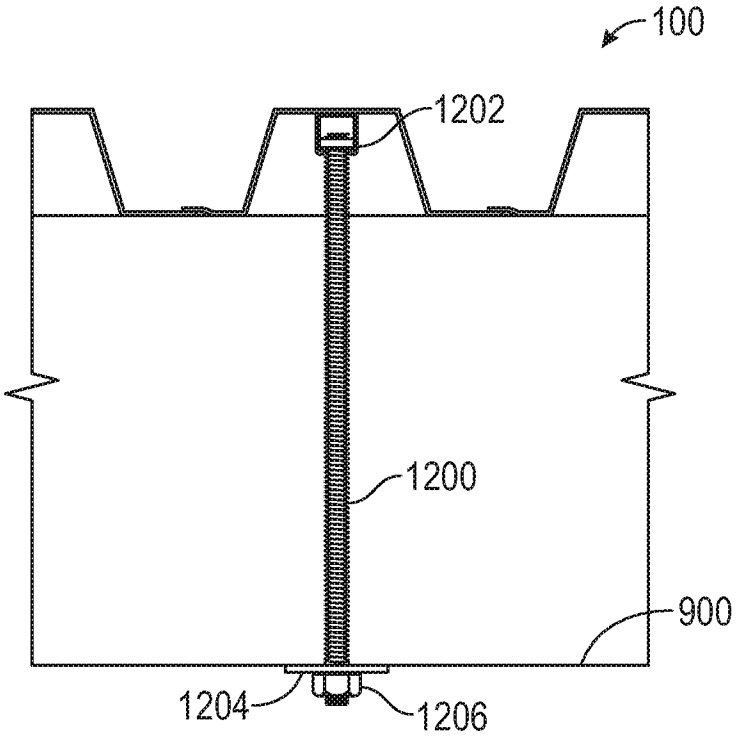
FIG. 13 is a side elevation view of the connection shown in FIG. 12.
Figure 12:
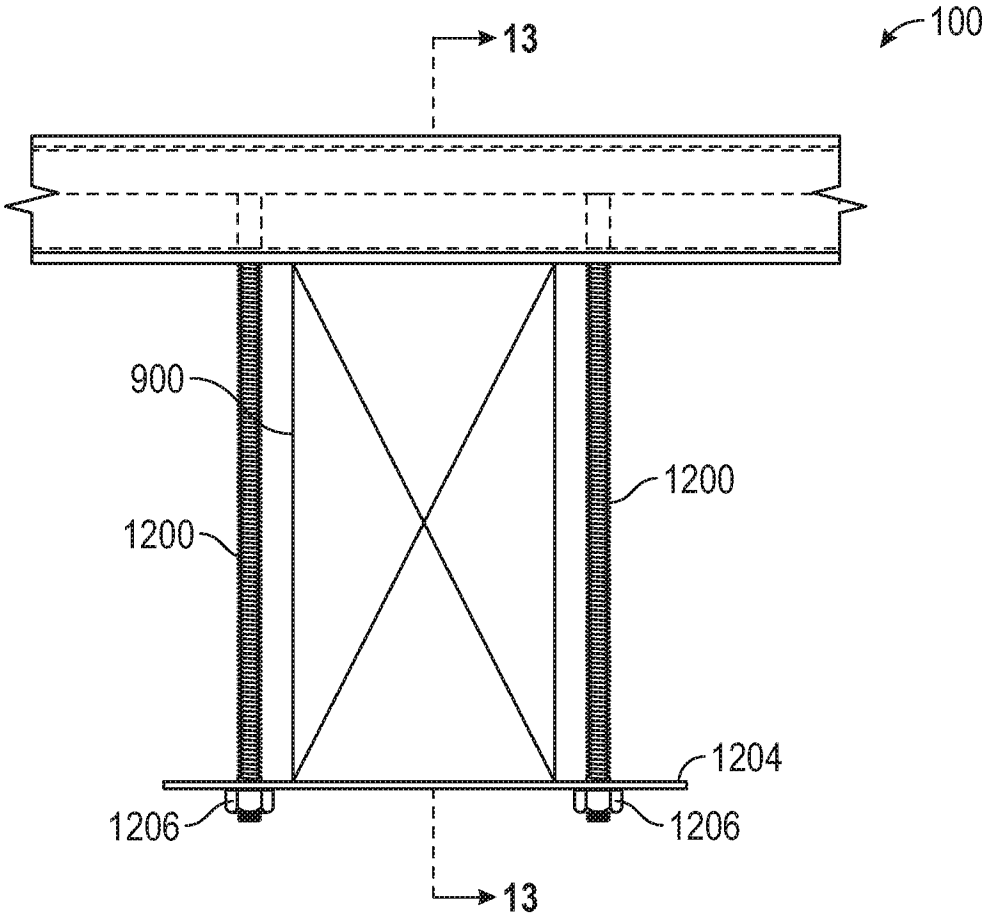
FIG. 12 is an end elevation view of a connection of a panel to an existing stringer according to an embodiment of the present disclosure.

One example of connection of a panel 100 to an existing wood stringer 900 is shown in FIGS. 12 and 13. In one embodiment, threaded anchor rods 1200 are used that are threaded through a unistrut-type deck runner 1202 alongside a stringer 900 to a plate 1204 that is braced on a bottom of the stringer 900, and secured with nuts 1206 so affix the panel to the existing wood stringers 900. It should be understood that different configurations and attachment structures may be used without departing from the scope of the disclosure.

When replacing bridge decks on concrete or wood stringers, a unistrut channel may be welded in the valley of the corrugations, headed all thread is inserted into the unistrut channel, and a shop fabricated plate with nuts and washers is used to pull the prefabricated deck panels tight to the existing wood, concrete or steel girders.

A method of installing new decking according to an embodiment of the disclosure comprises removing the original structure to the underlying girders, placing a single large panel or panels with predrilled holes and prefabricated blade runners, side dams, and end dams, or some combination thereof, and repaving or graveling over the new deck material.

Some features and benefits of the embodiments of the present disclosure are listed below.

Prefabricated galvanized corrugated deck panels simplify installation procedures, and provide time savings during installation, due to at least some of (1) larger components than are typically used, (2) prefabricated mounting and connection holes, (3) side and end dams, and (4) blade runners. Further, use of corrugated galvanized steel sheets of the sizes provided in embodiments of the present disclosure increases lateral stiffness of the bridge and increases loading capabilities.

Embodiments of the present disclosure may be used for new field-built bridges, or to rehabilitate existing bridges. Embodiments of the present disclosure, by virtue of faster and easier installation, reduce the duration of road closures due to placing replacement decking.

Types of existing structures for which embodiments may be used include steel, concrete or timber bridge substructures. Further, embodiments are applicable to all types of pavements including asphalt, concrete and gravel.

Galvanized corrugated deck panels of the present embodiments are designed to meet all applicable AASHTO regulations:

G200 galvanized coating weight per ASTM A653

Long lasting galvanized coating extends bridge life. Additional coatings that may be used include, by way of example only and not by way of limitation, aluminized and polymer coated panels.

Engineering support for net allowable span requirement between girders Allows customer to determine gauge (thickness) of corrugated material required based on engineered net allowable spans.

Prefabricated corrugated deck panels are pre-punched to weld, bolt or attached to existing girders. Pre-punching the galvanized corrugated deck to match the existing bridge girders simplifies the installation and increases production. Steel side and end dams are shop installed to contain road ballast or other finished deck material. Pre-installed side and end dams eliminate welding in the field, saving time, and increasing safety.

End beveled shop installed blade runners for gravel ballast decks may be pre-installed. Pre-installed tube steel blade runners allow for maintenance crews to blade the ballast deck without damaging the galvanized corrugated deck.

Welding is reduced. Internal deck splice plates are shop installed to bolt adjacent panels together. A simple bolted connection between panels eliminates welding. All of the work is performed on top of the bridge structure, increasing safety and reducing installation time.

What is claimed is:

1. A pre-fabricated deck panel for a vehicular bridge, comprising:

a plurality of continuous corrugations extending transversely along a width of the panel from a first end of the panel to a second end of the panel, in an opposite direction to normal vehicular travel over the deck panel;

a pre-installed end dam on at least one end of the panel, the pre-installed end dam extending in a direction of the plurality of corrugations and extending to a height of the corrugations;

a pre-installed side edge dam on at least one side of the panel, the side edge dam extending to a height above the corrugations;

a pre-fabricated splice edge on at least one side of the panel, the splice edge extending to a height of the corrugations;

a plurality of preformed splice holes configured to connect an adjacent panel to the panel along the edge having the splice edge; and a plurality of preformed holes in the corrugations, the preformed holes positioned according to a known girder arrangement of an existing vehicular bridge structure.

2. The pre-fabricated panel of claim 1, and further comprising a blade runner extending longitudinally along the length, the blade runner positioned above the plurality of continuous corrugations, above the pre-installed side edge dam, and above the pre-fabricated splice edge, to prevent damage of the plurality of continuous corrugations, the pre-installed side edge dam, and the pre-fabricated splice edge during maintenance or plowing of the vehicular bridge.

3. The pre-fabricated panel of claim 2, wherein the blade runner comprises tube steel.

4. The pre-fabricated deck panel of claim 2, wherein ends of the blade runner, at the first end of the panel and the second end of the panel are beveled to provide a ramped entrance and exit to the pre-fabricated decking panel.

5. A pre-fabricated decking panel for a vehicular roadway, comprising:

a plurality of continuous corrugations having troughs extending laterally from a first side edge of the panel to a second opposite side edge of the panel, in an opposite direction to normal vehicle travel over the decking panel, and the corrugations extending continuously for a length of the panel from a first end to a second opposite end;

a pre-fabricated side edge dam on at least one side of the panel, the pre-fabricated side edge dam extending to height above the corrugations;

a pre-fabricated end dam on at least one end of the panel, the pre-fabricated end dam extending from the first side edge to the opposite edge and to a height of the corrugations;

a pre-fabricated splice edge on an other side of the panel from the pre-fabricated side edge dam, the splice edge extending to a height of the corrugations, wherein the pre-fabricated splice edge includes a plurality of pre-formed splice holes configured to connect an adjacent pre-fabricated decking panel to the panel along the pre-fabricated splice edge; and a plurality of pre-formed holes in the corrugations, the pre-formed holes positioned according to a known girder arrangement of an existing external structure.

6. The pre-fabricated decking panel of claim 5, and further comprising a blade runner extending along the length from the first end to the second opposite end, the blade runner positioned above the plurality of continuous corrugations, above the pre-installed side edge dam, and above the pre-fabricated splice edge, to prevent damage of the plurality of continuous corrugations, the pre-installed side edge dam, and the pre-fabricated splice edge during maintenance or plowing of the vehicular bridge.

7. The pre-fabricated decking panel of claim 6, wherein the blade runner comprises tube steel.

8. The pre-fabricated decking panel of claim 6, wherein ends of the blade runner, at the first end of the panel and the second end of the panel are beveled to provide a ramped entrance and exit to the pre-fabricated decking panel.

9. A method of installing a vehicle bridge decking surface on a vehicle bridge, comprising:

placing at least one pre-fabricated steel vehicle bridge decking panel, for the vehicular bridge, having a plurality of continuous corrugations having troughs extending transversely along a width thereof on an existing vehicular bridge support structure of the vehicular bridge perpendicular to a direction of vehicular travel across the vehicular bridge, the corrugations extending continuously for a length of the panel from a first end to a second opposite end, wherein the pre-fabricated steel vehicle bridge decking panel is a complete bridge decking surface for the vehicular bridge, and wherein the pre-fabricated steel vehicle bridge decking panel is provided with a pre-installed end dam at each end, and with a pre-installed side dam at each side; and connecting the at least one pre-fabricated decking panel to the existing bridge support structure using pre-formed holes therein.

10. The method of claim 9, wherein at least one blade runner is positioned above the corrugations and extending between the end dams.

11. The method of claim 10, and further comprising filling the corrugations of the pre-fabricated steel vehicle bridge decking panel with a decking material after the pre-fabricated decking panel is installed on the vehicle bridge decking surface.

12. The method of claim 9, and further comprising connecting additional pre-fabricated decking panels to complete the bridge decking surface, each pre-fabricated decking panel having at least one of a pre-fabricated end dam, a pre-fabricated side dam, a splice edge, or a splice end.

13. The method of claim 12, and further comprising filling the corrugations of the pre-fabricated steel vehicle bridge decking panels of the completed bridge decking surface with a decking material after the pre-fabricated decking panel is installed on the vehicle bridge decking surface.

14. The method of claim 13, wherein filling the completed bridge decking surface comprises filling the corrugations with gravel after the pre-fabricated decking panel is installed on the vehicle bridge decking surface.

* * * * *